US006930579B2

(12) United States Patent
Radford et al.

(10) Patent No.: US 6,930,579 B2
(45) Date of Patent: Aug. 16, 2005

(54) LOW VOLTAGE COMPOSITE MOLD

(75) Inventors: Larry Radford, Bland, VA (US); James M Munsey, Bland, VA (US); Ray Puckett, Bland, VA (US); Charlie Sarver, Rocky Gap, VA (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 10/459,055

(22) Filed: Jun. 11, 2003

(65) Prior Publication Data

US 2004/0251998 A1 Dec. 16, 2004

Related U.S. Application Data

(60) Provisional application No. 60/573,952, filed on May 25, 2004.

(51) Int. Cl.[7] ..... H01F 27/02

(52) U.S. Cl. ..... 336/90; 336/206; 336/212

(58) Field of Search ..... 336/90, 206, 182, 336/199, 220, 179, 209

(56) References Cited

U.S. PATENT DOCUMENTS

| | | | | | |
|---|---|---|---|---|---|
| 4,095,206 | A | * | 6/1978 | Hishiki | 336/96 |
| 4,337,219 | A | | 6/1982 | Falkowski et al. | |
| 4,540,536 | A | | 9/1985 | Altmann et al. | |
| 5,036,580 | A | | 8/1991 | Fox et al. | |
| 5,589,808 | A | * | 12/1996 | Clark et al. | 336/92 |
| 5,633,019 | A | | 5/1997 | Clark et al. | |
| 6,221,297 | B1 | * | 4/2001 | Lanoue et al. | 264/219 |
| 6,223,421 | B1 | * | 5/2001 | Lanoue et al. | 29/605 |
| 6,624,734 | B2 | * | 9/2003 | Lanoue et al. | 336/90 |
| 2002/0101315 | A1 | * | 8/2002 | Hamer et al. | 336/90 |

* cited by examiner

*Primary Examiner*—Anh Mai
(74) *Attorney, Agent, or Firm*—Burns, Doane, Swecker & Mathis, L.L.P.

(57) ABSTRACT

A transformer coil is produced by forming a sheet of composite material over a plurality of annular shaped support plates to form an inner layer. A coil is wound around the inner layer. An outer layer is formed by wrapping a sheet of composite material over the coil. The outer layer is mechanically attached to the coil. A base is attached to the coil assembly and epoxy is used to encapsulate the coil. The epoxy forms a bond with the inner and outer layers, which become an integral part of the transformer coil.

18 Claims, 4 Drawing Sheets

LOW VOLTAGE COMPOSITE MOLD

RELATED APPLICATIONS

The present non-provisional application claims priority under 35 U.S.C. §119(e) of Provisional Application Ser. No. 60/573,952, entitled: Method and System For Presenting Actions Associated With A Managed Object In A Task Context, filed May 25, 2004, Mark S. Anspach, Evelyn L. Williams, Rock D. Barney and Robert Raymond, the disclosure of which is hereby incorporated by reference in its entirety.

BACKGROUND

This invention generally relates to transformer coils. More particularly, the present invention provides a method of producing a encapsulated transformer coil with composite inner and outer layers.

Commonly assigned U.S. Pat. No. 6,221,297 to Lanoue et al. discloses a method of manufacturing transformer windings embedded in casting resin. A disposable mold is formed around support plates and is used as a winding mandrel. The disposable mold is formed from steel sheet material. After the coil is wound, another sheet of steel is applied to the outside. Epoxy is applied between the two sheets of steel and allowed to cure. Afterward, the steel sheets are removed, leaving an epoxy-encapsulated core.

SUMMARY

In accordance with the present invention, a transformer coil is manufactured by forming an inner layer by wrapping a sheet of composite material over a plurality of annular shaped support plates. A coil is wound around the inner layer. An outer layer is formed by wrapping a sheet of composite material over the coil. A coil assembly is formed by mechanically attaching the outer layer to the coil, and a base is attached to the coil assembly. A seal is provided between the base and the coil assembly to prevent epoxy leaks during the encapsulation process. The coil assembly is filled with epoxy to encapsulate the coil.

In accordance with another aspect of the invention, at least the inner layer becomes a part of the transformer coil.

In accordance with another aspect of the invention, a transformer coil is produced having an inner layer, a plurality of coil windings, an outer layer, and an epoxy material that encapsulates the coil windings and forms a first bond between the coil windings and the inner layer and forms a second bond between the coil windings and the outer layer.

It should be emphasized that the term "comprises" or "comprising," when used in this specification, is taken to specify the presence of stated features, steps, or components, but does not preclude the presence or addition of one or more other features, steps, components, or groups thereof.

BRIEF DESCRIPTION OF DRAWINGS

The objects and advantages of the invention will be understood by reading the following detailed description in conjunction with the drawings in which.

DETAILED DESCRIPTION

Figure 1:
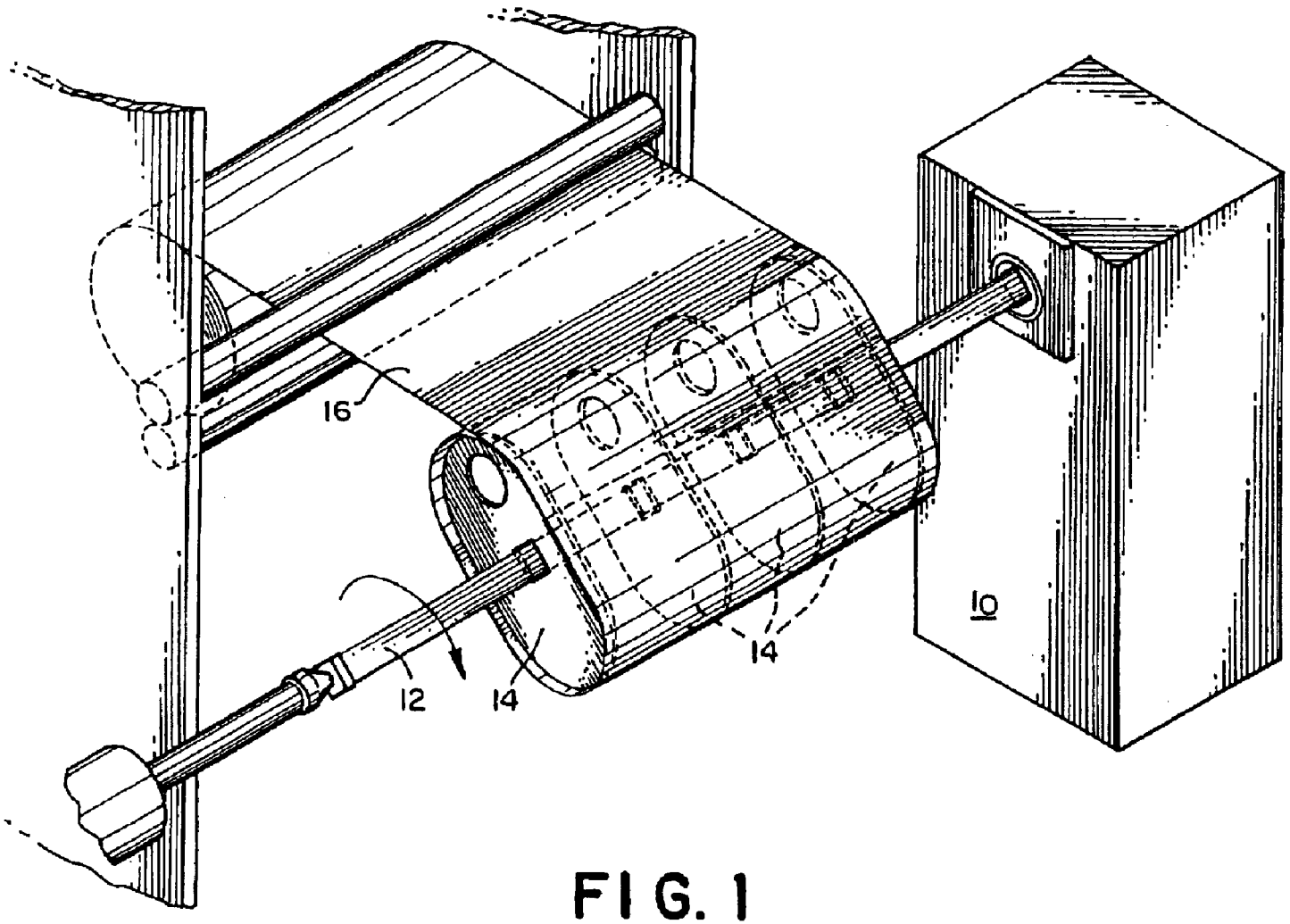
FIG. 1 is a perspective view illustrating the winding of composite material onto a mandrel for use in manufacturing a transformer coil in accordance with the method of the present invention.

FIG. 1 depicts a coil winding machine 10 having a conventional square mandrel shaft 12. Inner support plates 14 are applied to the mandrel shaft 12. The size and shape of the inner support plates 14 establish the size and shape of the finished coil. For example, the inner support plates 14 shown in FIG. 1 are elliptical or oval in shape and may be used to produce a coil having an oval configuration. The inner support plates 14 may be fabricated from any suitable material, such as 11 gauge steel. The number and arrangement of the inner support plates depends for the most part on the size of the transformer. For example, FIG. 1 shows four inner support plates 14 that are equally spaced on the square mandrel shaft 12. Spacer tubes, not shown, may be mounted on the mandrel 12 between the inner support plates 14 to maintain the spacing between the inner support plates 14. Various lengths of spacer tubes may be used to accommodate various coil axial lengths. Lead support plates, not shown, may be provided to hold the start lead in position during the winding process. The lead support plates may be positioned near the ends of the mandrel 12 and keep the lead from sliding around the mold due to the tension of the winding machine.

A sheet of composite material 16 is wrapped over the inner support plates 14. The composite material 16 is mechanically attached to the inner support plates 14 by a slot, not shown, in the support plates. This locks the sheet of composite material 16 into position so that the sheet can be tightly wrapped around the inner support plates 14, thus eliminating any material slippage during the wrapping process. The composite material 16 is applied continuously in several overlapping layers. The composite material is preferably non-conductive and flexible. Suitable materials include fiberglass, mylar, carbon fiber, and plastics.

The sheet of composite material 16 forms the inner layer 20 of the transformer coil and serves as the mandrel base for the coil winding process. The wrapped sheet of composite material 16 is held or secured in place with non-adhesive glass tape. A plastic tape, for example Mylar tape, is applied over the entire length of the inner layer 20. The Mylar tape seals the inner layer 20 for the subsequent epoxy encapsulation process.

Figure 2:
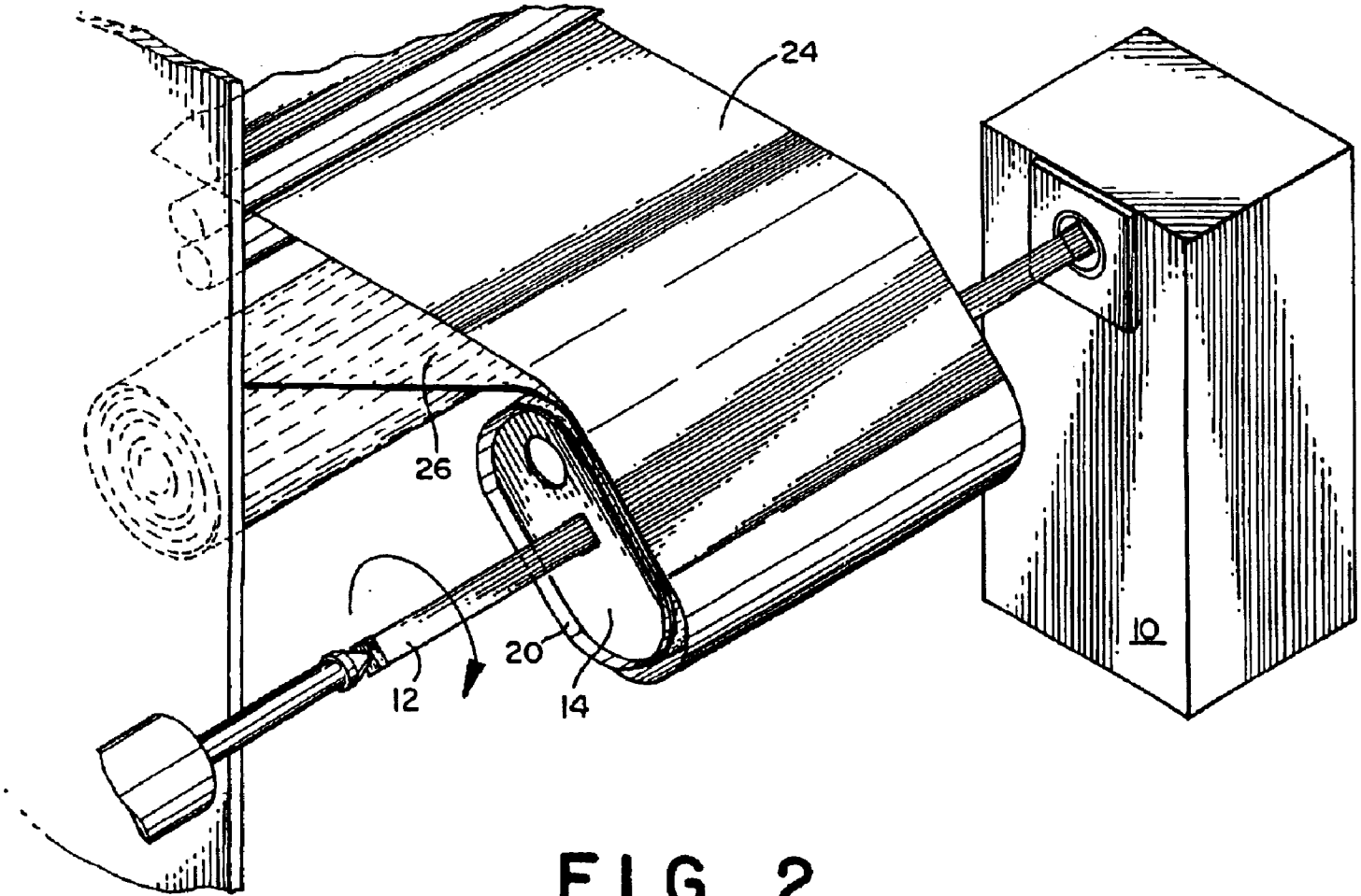
FIG. 2 is a perspective view illustrating the step of winding insulating tape and conductor onto the inner layer to produce the coil of the transformer.
Figure 3:
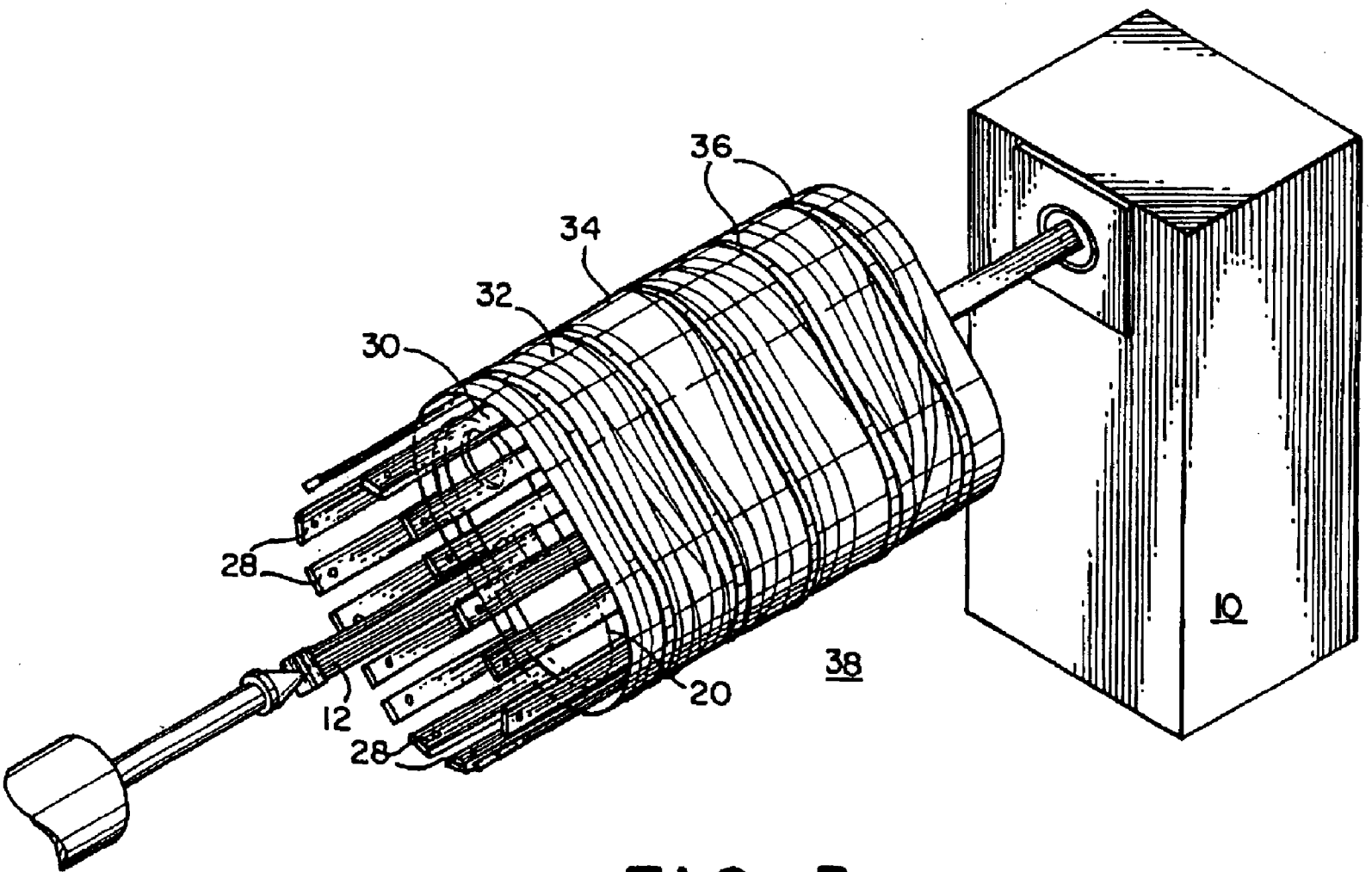
FIG. 3 is a perspective view showing the coil, wound on the inner layer and an outer layer applied over the coil with cooling duct bars inserted between layers of the coil to produce a manufactured coil assembly.

After the inner layer 20 has been completed, the coil is wound on the inner mold. As shown in FIG. 2, the coil is wound using alternate layers of copper conductor 24 and insulating tape 26 on the conventional winding machine 10. As shown in FIG. 3, cooling duct bars 28 are inserted during winding between every other layer of conductor to provide cooling ducts in the completed transformer. The cooling duct bars 28 are preferably coated with a lubricant, such as silicone, prior to being inserted between the coil layers to aid in their later removal from the encapsulated transformer coil. In addition to using cooling duct bars 28, other methods of providing cooling ducts may be used, such as those described in commonly assigned U.S. patent application Ser. No. 10/026,199.

After the coil windings 30 have been completed, an outer layer 34 is wrapped around the coil windings. The outer layer 34 is constructed of the same composite material as used in making the inner mold 20. A sheet of composite material is applied continuously in several overlapping layers, which are mechanically attached to the coil windings 30 with glass adhesive tape to hold the sheet in its starting position. After wrapping the sheet of composite material over the coil windings 30, non-adhesive glass tape 32 is spirally wrapped over the outer layer 34 to secure it in position. The outer layer 34 is secured by banding the mold with banding strip 36 in several locations, as shown in FIG. 3.

Figure 4:
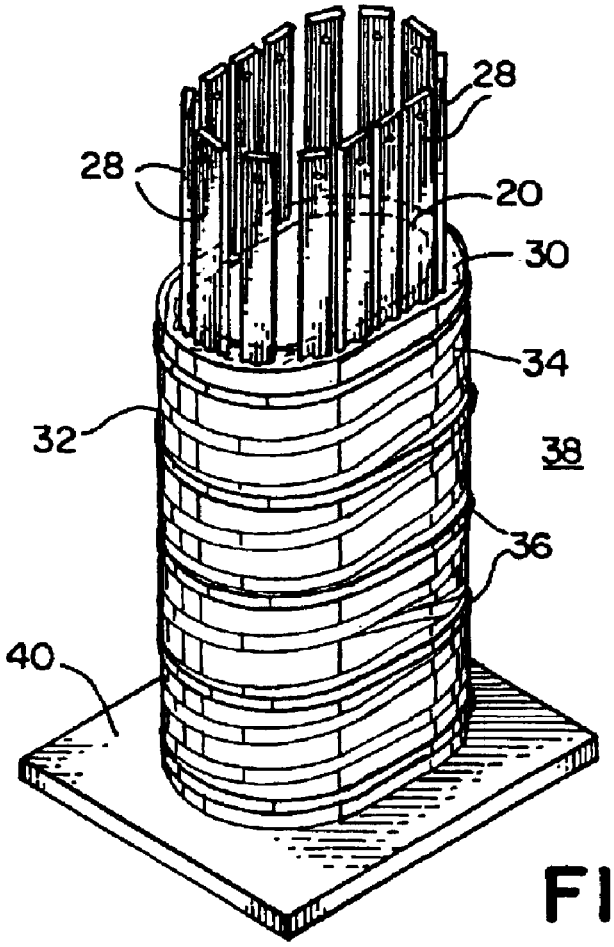
FIG. 4 is a perspective view of the manufactured coil assembly of FIG. 3 removed from the winding machine and placed in upright position on a molding base ready for epoxy encapsulation.

The wound coil and mold assembly 38 is removed from the winding machine 10 and uprighted for mounting and attachment to a molding base 40, as shown in FIG. 4. A mechanical arrangement, not shown, preferably including a threaded tie rod is provided for forcing the coil and mold assembly 38 downwardly toward the molding base 40 to compress a silicone gasket, not shown, against the molding base 40, thereby preventing epoxy leaks during the encapsulation process. Once the final assembly is complete as shown in FIG. 4, the assembly is ready for epoxy encapsulation. The encapsulation process is preferably a conventional vacuum encapsulation process used in manufacturing transformer coils.

Figure 5:
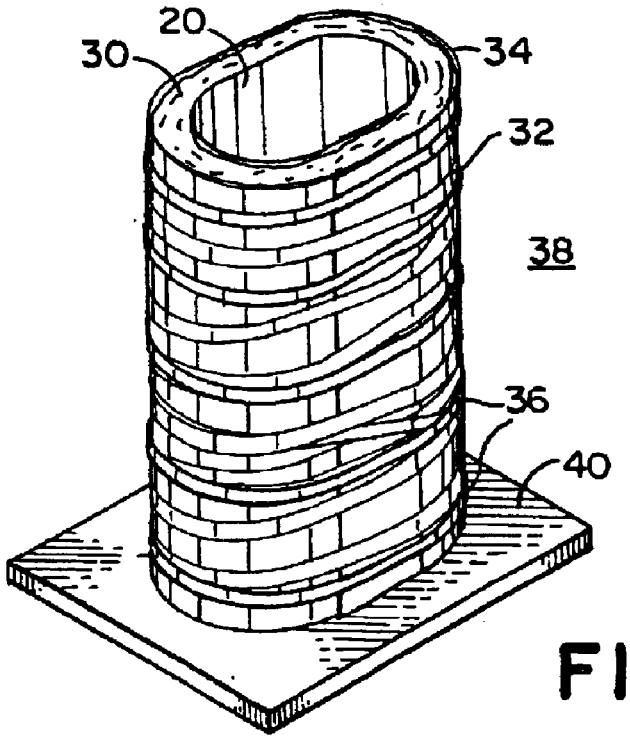
FIG. 5 is a perspective view illustrating the coil and mold assembly after encapsulation of the coil and removal of the cooling duct bars of FIG. 4.

After the mold and coil assembly 38 has been encapsulated, the cooling duct bars 28, FIG. 4, are removed as shown in FIG. 5. After removal of the cooling duct bars, the banding straps 36 holding the outer mold 34 are removed. The mechanical structure securing the mold and coil assembly 38 to the molding base 40 are removed, and the encapsulated coil 30 is removed from the molding base 40.

From the foregoing, one would appreciate that the disclosed method and resulting transformer coil provide improvements upon the prior art. The use of composite inner and outer layers, which become an integral part of the transformer coil, eliminates the need for the steel mold known to the art. As a result, material waste and labor costs associated with using the steel mold are eliminated. Moreover, the composite inner and outer layers provide increased dielectric insulation between the high and low voltage coils.

The invention has now been described with respect to one embodiments. In light of this disclosure, those skilled in the art will likely make alternate embodiments of this invention. These and other alternate embodiments are intended to fall within the scope of the claims which follow.

What is claimed is:

1. A method of manufacturing a transformer coil comprising the steps of:

forming an inner layer by wrapping a sheet of composite material over a plurality of annular shaped support plates;

winding a coil around the inner layer;

forming an outer layer by wrapping a sheet of composite material over the coil;

mechanically attaching the outer layer to the coil, thereby forming a coil assembly;

attaching a base to the coil assembly;

providing a seal between the base and the coil assembly to prevent epoxy leaks during the encapsulation process; and filling the coil assembly with epoxy to encapsulate the coil.

2. The method of claim 1 wherein at least the inner layer becomes a part of the transformer coil.

3. The method of claim 1 wherein the inner layer and outer layer become part of the transformer coil.

4. The method of claim 1 wherein the composite material is an insulating material.

5. The method of claim 4, wherein the composite material includes fiberglass.

6. The method of claim 1, comprising forming a sealing layer between the inner layer and the coil.

7. The method of claim 1, wherein the outer layer is formed by overlapping layers of the sheet of composite material.

8. The method of claim 1, wherein the inner layer is formed by overlapping layers of the sheet of composite material.

9. A transformer coil comprising:

an inner layer;

a plurality of coil windings;

an outer layer; and an epoxy material that encapsulates the coil windings and forms a first bond between the coil windings and the inner layer and forms a second bond between the coil windings and the outer layer, wherein the inner layer and the outer layer each comprise a composite material.

10. The transformer of claim 9, wherein the composite material is non-conductive.

11. The transformer of claim 9, wherein the composite material is an insulating material.

12. The transformer of claim 11, wherein the composite material comprises fiberglass.

13. The transformer of claim 9, the inner layer comprising a sealing layer between the composite material and the coil windings.

14. The transformer of claim 9, wherein the outer layer is formed by overlapping layers of the sheet of composite material.

15. The transformer of claim 9, wherein the inner layer is formed by overlapping layers of the sheet of composite material.

16. The transformer of claim 9, wherein the coil windings are formed from alternating layers of a conducting material and an insulating material.

17. The transformer of claim 9, wherein the inner layer and the outer layer each comprise a sheet of composite material wrapped over a plurality of support plates.

18. The transformer of claim 17, wherein each of the support plates has an annular shape.

* * * * *

UNITED STATES PATENT AND TRADEMARK OFFICE

CERTIFICATE OF CORRECTION

PATENT NO. : 6,930,579 B2
APPLICATION NO. : 10/459055
DATED : August 16, 2005
INVENTOR(S) : Larry Radford et al.

It is certified that error appears in the above-identified patent and that said Letters Patent is hereby corrected as shown below:

On the title page Item (63), "Related U.S. Application Data" is cancelled.

Column 1, Lines 2 - 11, the heading "Related Applications" and the paragraph below that heading are cancelled.

Signed and Sealed this
Twenty-first Day of August, 2012

David J. Kappos

David J. Kappos
*Director of the United States Patent and Trademark Office*